United States Patent [19]

Hayward

[11] 4,400,050

[45] Aug. 23, 1983

[54] FITTING FOR COAXIAL CABLE

[75] Inventor: Robert D. Hayward, Phoenix, Ariz.

[73] Assignee: Gilbert Engineering Co., Inc., Phoenix, Ariz.

[21] Appl. No.: 264,640

[22] Filed: May 18, 1981

[51] Int. Cl.[3] ..... H01R 17/04

[52] U.S. Cl. ..... 339/177 R; 339/223 R

[58] Field of Search ..... 339/103 R, 103 M, 177 R, 339/177 E, 223 R, 223 S, 89 C, 90 C; 174/84 C, 88 C

[56] References Cited

U.S. PATENT DOCUMENTS

| | | | |
|---|---|---|---|
| 2,479,483 | 8/1949 | Ekleberry | 339/177 R |
| 2,604,508 | 7/1952 | Bergan | 174/84 C |
| 2,941,028 | 6/1960 | Edlen et al. | 339/177 R |
| 3,406,373 | 10/1968 | Forney | 339/177 R |
| 3,488,625 | 1/1970 | Collin | 339/177 R |
| 4,110,716 | 8/1978 | Nikitas | 174/88 C |

*Primary Examiner*—Eugene F. Desmond
*Assistant Examiner*—David Pirlot
*Attorney, Agent, or Firm*—Don J. Flickinger

[57] ABSTRACT

A fitting, especially adapted for electrical and mechanical connection to a coaxial cable having a jacket of noncompliant material with an antifriction surface, includes a tubular element having internal gripping means for mechanically engaging the jacket. The gripping means comprises a plurality of gripping elements each having an inwardly directed point which is embedded into the jacket in response to constrictive crimping of the tubular element.

9 Claims, 8 Drawing Figures

FITTING FOR COAXIAL CABLE

FIELD OF THE INVENTION

This invention relates to cable transmission systems.

In a further aspect, the present invention relates to fittings for connecting a coaxial cable to a selected device within a cable transmission system.

More particularly, the instant invention concerns improved means for electrically and mechanically securing a fitting to the end of a coaxial cable.

PRIOR ART

Conventionally, coaxial cable systems are used to transmit signals within office buildings, sale outlets, apartment complexes, residences, and other structures. Exemplary is the transmission of television signals from an antenna, as in a multi-unit dwelling, to a television receiver sets located within several individual apartments. Similarly, in a commercial or industrial establishment, a central computer may communicate with various peripheral equipment located throughout the building. Intermediate terminations, the system may typically include other selected ancillary devices, such as couplers, directional taps and amplifiers.

Commercially available coaxial cable of the type commonly employed in such systems generally includes a solid center conductor and a tubular outer conductor separated by a dielectric. The outer conductor is encased in an insulative jacket. While the conductive elements may be fabricated of various metals, such as steel, copper or aluminum, the insulative components, the dielectric and the jacket, are commonly fabricated of polyethelene or polyvinyl chloride (PVC).

Various fittings are used throughout the system. A fitting, for example, is interposed between the lengths of cable and the devices. One end of the fitting is mechanically and electrically connectable to the cable, while the other end is especially adapted for attachment to the immediate device.

Prior art means for securing the cable typically includes a pair of tubular elements coaxially extending from the body of the fitting. During assembly, the end of the cable is received within the outer tubular element while simultaneously, the inner tubular element is forced between the dielectric and the outer conductor. Subsequently, the outer tubular element is constrictively crimped for fixation. The strength of the union is primarily due to a plurality of spaced annular rings encircling the inner tubular element and which become embedded into the outer conductor and the jacket as a result of the crimping action.

During installation, the cables are extended through any convenient passage within the building. In residential structures, television cables are usually located within attics and crawl spaces. In commercial structures, cables for security systems, business machine interconnects and other purposes are commonly routed through the enclosed space formed by the familiar drop ceiling.

The space enclosed by the drop ceiling, analogous to attics and crawl spaces, is continuous throughout the length and width of the level of the building. The drop ceiling supports lighting and other ceiling mounted fixtures. The enclosed space, which serves as a return air plenum for heating and cooling systems, provides a convenient passage for transmission lines.

Recently, there has arisen national concern over the routing of electrical cables through the space above the drop ceiling. A fire occurring in one are of the building can be contained by walls and other fire stops on the floor level. However, the fire can quickly spread throughout the entire story of the building as a result of flammable material within the plenum. Polyvinyl chloride, the insulative material commonly used in conventional coaxial cable, is a flammable material.

Accordingly, manufacturers have begun supplying coaxial cable which is insulated and jacketed with teflon. It is claimed that the new cable provides lower smoke emission and flame spreading than PVC insulated cable when encased in a metal conduit. The newly developed cable is known in the trade as "return air plenum coax". For further information concerning plenum cable, attention is directed to two current manufacturers, Times Wire & Cable Company, Wallingford, Connecticut and Mili Bride, Inc./Belden, Williston, Vermont.

Use of the newly developed return air plenum coax has presented problems not heretofore encountered by the art. Teflon is substantially rigid and noncompliant, thereby rendering useless prior art fittings of the type conventionally secured to the ends of coaxial cable. Teflon, for example, is sufficiently non-elastic to prohibit the entrance of the typical prior art inner tubular member between the dielectric and the outer conductor. Having an antifriction surface, teflon defies attachment of the outer tubular member by conventional crimping means. The nonavailability of an acceptable fitting has seriously limited the use of the newly developed return air plenum coax.

It would be highly advantageous, therefore, to remedy the deficiencies inherent in the prior art.

Accordingly, it is an object of the present invention to provide an improved coaxial cable fitting.

Another object of the invention is the provision of improved means for electrically and mechanically securing a fitting to a coaxial cable.

And another object of the invention is to provide a fitting especially adapted for use with coaxial cable of the type having noncompliant jacket material.

Still another object of this invention is the provision of improved gripping means for mechanical attachment to a generally antifrictional surface.

Yet another object of the invention is to provide an improved fitting which can be used interchangably with prior art fittings.

Yet still another object of the immediate invention is the provision of an improved fitting having the same general size, shape and appearance as prior art fittings.

And a further object of the invention is to provide improved cable attachment means which may be used in connection with conventional prior art fittings.

Still a further object of the instant invention is the provision of a new and novel fitting which is readily fabricatable in accordance with pre-existing technology and machinery.

And still another object of the invention is to provide an improved fitting which is conveniently field installed with traditional skills and tools.

Yet still a further object of the invention is the provision of an improved fitting of the above type which is relatively inexpensive and maintenance free.

SUMMARY OF THE INVENTION

Briefly, to achieve the desired objects of the instant invention in accordance with a preferred embodiment thereof, provided is an electrically conductive body having a projecting elongate outer tubular element for receiving the end of the coaxial cable and connection means for attachment to a selected device. Internal gripping means are carried by the outer tubular element. The gripping means mechanically engage the jacket in response to inward deformation, or constrictive crimping, of the outer tubular element. The fitting may also include an elongate inner tubular element, projecting coaxially with the outer tubular element, having a relatively thin, smooth sidewall receivable between the dielectric and the outer conductor of the coaxial cable.

In accordance with a more specific embodiment of the invention, the gripping means includes a plurality of spaced apart inwardly directed gripping elements. To enhance the connection between the fitting and the cable, it is suggested that the outer conductor, which includes a braid of electrically conducted strands, is doubled back at the end of the cable to encircle the terminal portion of the jacket. Each gripping element includes an inwardly directed point moving between the strands and sloping side surfaces for deflecting the strands to strand receiving recesses defined between the gripping elements.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which.

DETAILED DESCRIPTION OF THE PREFERRED EMBODIMENTS

Figure 1:
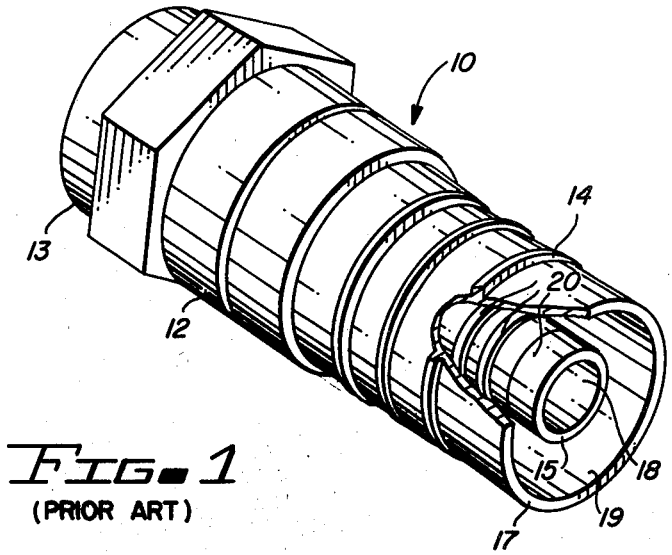
FIG. 1 (PRIOR ART)
FIG. 1 is a perspective view, partly broken away for purposes of illustration, of a conventional prior art fitting illustrated herein for purposes of comparison.

Turning now to the drawings in which like reference characters indicate corresponding elements throughout the several views, attention is first directed to FIG. 1 which illustrates a conventional prior art fitting generally designated by the reference character 10. Fitting 10 includes an electrically conductive body 12 usually fabricated of a malleable metal such as brass or aluminum. Carried by body 12 are connection means 13 for detachable union with a selected device and securement means 14 for attachment to the end of a conventional coaxial cable.

Securement means 14 includes inner and outer tubular elements, 15 and 17 respectively, projecting coaxially from body 12. Inner tubular element 15 and outer tubular element 17 are characterized by smooth bores 18 and 19, respectively. A plurality of spaced annular projections 20 encircle inner tubular element 15.

During assembly, inner tubular element 15 is received between the dielectric and the outer conductor of the coaxial cable. Bore 18 is sized to closely receive the dielectric. Bore 19 is sized to closely receive the jacket. Subsequently, outer tubular element 17 is constrictively swaged by a conventional commercially available crimping tool. During the crimping operation, the outer conductor and the jacket, being fabricated of compliant material, are deformed to become mechanically interlocked with annular projections 20. Bore 19 is frictionally engaged with the jacket. Accordingly, a secure and positive mechanical bond is established with the cable and an electrical connection is established between body 12 and the outer conductor. In addition to be compliant, the traditional jacket material, commonly polyvinyl chloride, is sufficiently yielding to readily expand to accomodate inner tubular element 15.

Connection means 13 is provided with an internal thread of standard configuration for detachable securement to splitters, directional caps, amplifiers, adaptors, connectors, and other commercially available selected devices. For convenience, securement means 13 is pivotally connected to body 12 and provided with a hexagonal section for receiving a conventional wrench.

The foregoing discussion is presented for purposes of reference and orientation with regard to the immediate invention as set forth in the ensuing discussion. Although specifically illustrated as a cable end, fitting 10 is considered to be typical of various commercially available prior art fittings having means for attachment to the end of a conventional coaxial cable, the subject to the which the instant invention pertains. Structure not expressly illustrated nor discussed will be readily visualized and understood by those skilled in the art.

Figure 2:
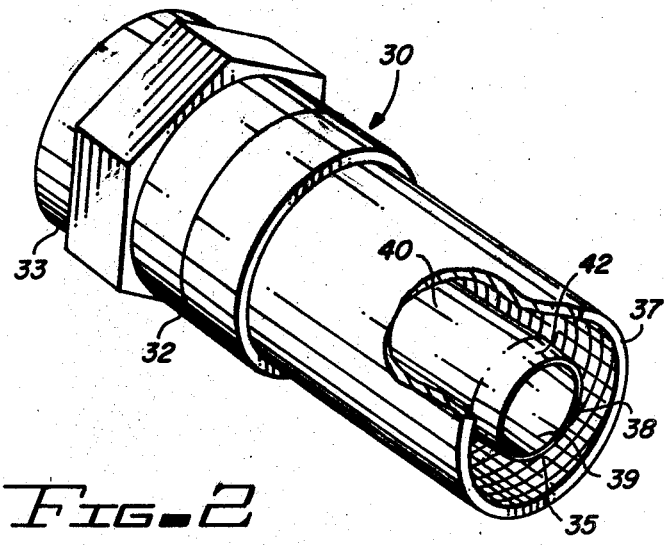
FIG. 2 is a perspective view, partly broken away for purposes of illustration, of a fitting constructed in accordance with the teachings of the instant invention.

FIG. 2 illustrates an improved fitting, generally designated by the reference character 30, embodying the principles of the instant invention for use in connection with coaxial cable of the type commercially known as return air plenum coax. In general similarity to prior art fitting 10, fitting 30, being interchangable therewith, includes electrically conductive body 32 having connection means 33 for a detachable attachment to a standard commercially available device of selected character, and securement means 34 for electrical and mechanical union with coaxial cable. While securable to a conventional coaxial cable, improved securement means 34 are especially adapted for electrical and mechanical connection with coaxial cable of the type having a substantially rigid noncompliant jacket, such as fabricated from teflon and incorporated in the type known as plenum cable. The structure of connection means 33 and the attachment thereof to body 32, is unchanged from the prior art. Securement means 34 includes inner and outer coaxial tubular elements 35 and 37, respectively, which are substantially different than the prior art.

Inner tubular element 35, projecting from body 32 and terminating with free end 38, includes smooth bore 39 and smooth outer surface 40. Outer surface 40 terminates with frustoconical taper 42. Inner tubular element 35 is also characterized by an exceedingly thin sidewall.

Experimentation has shown that a tubular element of properly dimensioned sidewall thickness can be inserted between the dielectric and the outer conductor of plenum type coaxial cable. For this purpose, it is preferred that the measurement of the diameter of bore 39 is approximately 90–95% of the measurement of the diameter of outer surface 40. For use in connection with standard coaxial cable in which the dielectric has a nominal diameter of 0.150 inches, it is suggested that the sidewall of the tubular member have a dimension in the range of 0.0055 to 0.0085 inches. For ease of assembly, in accordance with the immediately preferred embodiment of the instant invention, it is also suggested that taper 42 be not greater than approximately 17° from the longitudinal axis and that the free end 38 of inner tubular element 35 have a flat not greater than 0.005 inches.

Figure 3:
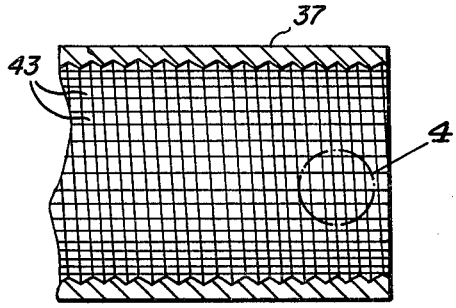
FIG. 3 is an enlarged elevation view of the interior sidewall of the outer tubular member of the device of FIG. 2.
Figure 4:
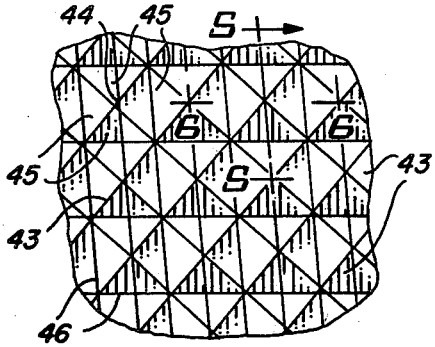
FIG. 4 is an enlarged fragmentary view of the area denoted by the inset 4 in FIG. 3.
Figure 5:
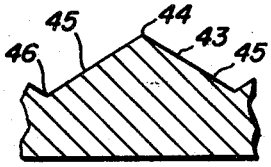
FIG. 5 is an enlarged vertical sectional view taken along the line 5—5 of FIG. 4.
Figure 6:
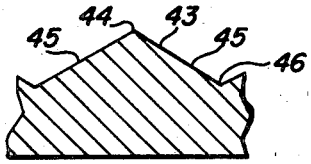
FIG. 6 is an enlarged vertical sectional view taken along the line 6—6 of FIG. 4.

Internal gripping means for securement to the jacket of a coaxial cable are carried by outer tubular element 37. The gripping means are especially adapted for mechanically engaging jackets of the type having antifriction surface such as used in connection with plenum cable. As further seen in FIGS. 3 and 4, the immediately preferred gripping means comprises a plurality of uniformly spaced gripping elements 43. Each gripping element 43, as further viewed in FIGS. 5 and 6, is generally pyramidal having an inwardly directed point 44 and sloping side surfaces 45. Being generally triangular, the sloping side surfaces 45 of each gripping element 43 diverge from point 44 to meet the sloping side surfaces 45 of each adjacent gripping element 43 to establish a grid of recesses 46 intermediate gripping elements 43.

Figure 7:
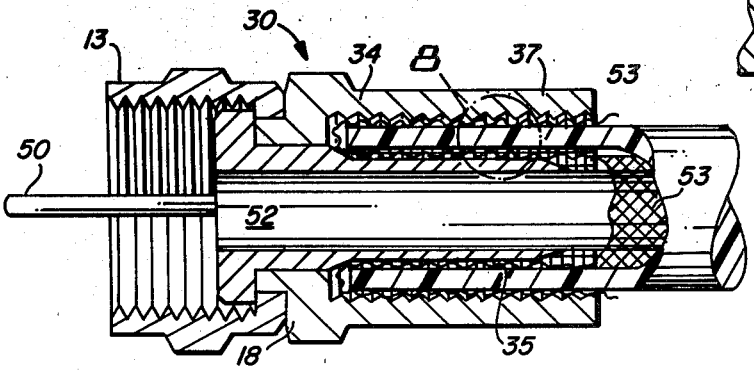
FIG. 7 is a vertical sectional view taken along the longitudinal axis of FIG. 2 and illustrating the device thereof as it would appear when mechanically and electrically secured to the end of a coaxial cable.
Figure 8:
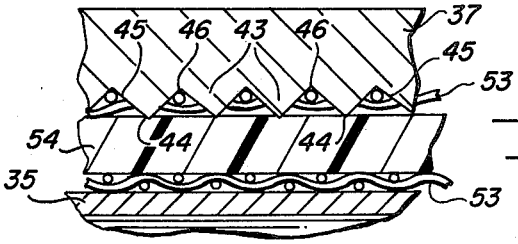
FIG. 8 is an enlarged fragmentary sectional view taken from the inset designated 8 in FIG. 7.

Coaxial cable, herein previously described, typically includes inner conductor 50, dielectric 52, outer conductor 53 and jacket 54 as illustrated in FIG. 7. It is noted that outer conductor 53 is in the form of a braid of wire strands. Peculiar to plenum type cable, dielectric 52 and outer jacket 54 are fabricated of a relatively rigid, fire resistent material having an antifriction surface, such as teflon. Plenum type cable is prepared for union with the fitting in a manner analogous to the preparation of conventional coaxial cable except that the outer conductor 53 is not terminated concurrent with jacket 54, but rather is left sufficiently long to be doubled back over the outside of jacket 54. The prepared cable end is then inserted into fitting 30 of the immediate invention and the outer tubular element 37 crimped in accordance with conventional practice.

During crimping, points 44 enter the spaces between the strands of the braid 53. The individual strands are deflected into recesses 46 by the sloping side surfaces 45. Points 44 are embedded into the outer surface of jacket 54. Inner tubular element 35 functions as an anvil opposing outer tubular element 37 and gripping elements 43. Accordingly, a secure and positive bond is formed between fitting 30 and the cable and the integrity of braid 53 is preserved.

The plurality of gripping elements 43 may be fabricated in accordance with various conventional metal working techniques. In accordance with a preferred embodiment of the invention, a relatively slow thread is first chased or tapped on the inside of outer tubular element 37. Subsequently, the interior of outer tubular element 37 is longitudinally broached. Formed is a continuous helical row of pyramidal shaped gripping elements. Alternately, the gripping means may be formed by superimposed right and left hand threads of somewhat slower helix. It is generally preferred that the included angle between side surfaces 45 is 60°. Other methods of producing a plurality of inwardly projecting gripping elements will readily occur to those having regard for the art.

The preferred embodiment of the instant invention includes inner tubular element 35 for purposes previously stated. In accordance therewith, outer conductor 53 and jacket 54 are compressed between the inner and the outer tubular elements. However, due to the firmness, or inflexibility, of the dielectric, teflon as used in plenum type cable, the inner tubular element may be eliminated from the gripping means. Various other modifications and variations to the invention, as hereinbefore described, will readily occur to those skilled in the art. To the extent that such modifications and variations do not depart from the spirit of the invention, they are intended to be included within the scope thereof which is assessed only by a fair interpretation of the following claims.

Having fully described and disclosed the present invention and alternately preferred embodiments thereof in such clear and concise terms as to enable those skilled in the art to understand and practice the same, the invention claimed is:

1. A fitting for mechanically and electrically connecting the end of a coaxial cable to a selected device, which includes an outer conductor comprising a braid of electrically conductive strands, a center conductor coaxial with said outer conductor, a noncompliant dielectric disposed between said outer and said center conductor, and a jacket of noncompliant material having an antifriction surface encasing said outer conductor, and for positive and secure attachment to said cable and for electrical connection with said outer conductor, said fitting comprising:

(a) an electrically conductive body including a projecting elongate outer tubular element for receiving the end of said cable and a projecting elongate inner tubular element coaxial with said outer tubular element and receivable between said noncompliant dielectric and said outer conductor;

(b) internal gripping means carried by said outer tubular element for mechanically engaging said jacket, said braid being doubled back at the end of said cable to encircle said jacket and said gripping means including a plurality of spaced apart gripping elements sized and shaped to be received between said strands in response to inward deformation of said outer tubular element, strand receiving recesses being defined between said gripping elements, said inner tubular element acting as a support means for opposing said inward deformation; and (c) connection means carried by said body for attachment to said selected device.

2. The fitting of claim 1, wherein said outer tubular element is inwardly deformable in response to an applied compressive force.

3. The fitting of claim 1, wherein each of said plurality of gripping elements is generally pyramidal including:

(a) an inwardly directed point for moving between said strands; and (b) sloping side surfaces for deflecting said strands and for guiding said strands toward said recesses.

4. The fitting of claim 3, wherein said inner tubular element includes:

(a) a smooth inner cylindrical surface; and (b) a smooth outer cylindrical surface.

5. The fitting of claim 4, wherein the diameter of said inner cylindrical surface of said inner tubular element has a measurement not less than 90% of the measurement of the diameter of said outer cylindrical surface.

6. The fitting of claim 3, wherein said plurality of gripping elements lie along a helical path.

7. The fitting of claim 3, wherein each of the side surfaces of said gripping elements slope at an angle of 60° from perpendicular to the longitudinal axis of said cable.

8. The fitting of claim 6, wherein said plurality of gripping elements and said strand receiving recesses are defined by:

(a) a generally V-shaped helical groove formed within said outer tubular element; and (b) a plurality of generally V-shaped straight grooves extending longitudinally within said outer tubular element.

9. The fitting of claim 6, wherein said plurality of gripping elements and said strand receiving recesses are defined by:

(a) a right hand generally V-shaped helical groove formed within said outer tubular element; and (b) a left hand generall V-shaped helical groove formed within said outer tubular element.

* * * * *